United States Patent [19]

Vredenburg, Sr.

[11] 4,398,576

[45] Aug. 16, 1983

[54] PACKER-FILLER MACHINE

[76] Inventor: Edric W. Vredenburg, Sr., P.O. Box 135, Fortine, Mont. 59918

[21] Appl. No.: 294,476

[22] Filed: Aug. 20, 1981

[51] Int. Cl.[3] ..... B65B 3/04

[52] U.S. Cl. ..... 141/68; 141/82; 141/114; 141/269; 141/315

[58] Field of Search ..... 141/10, 68, 114, 313–317, 141/82, 129, 250–284

[56] References Cited

U.S. PATENT DOCUMENTS 1,722,128 7/1929 Bushman ..... 141/68

*Primary Examiner*—Houston S. Bell, Jr.

*Attorney, Agent, or Firm*—Robert G. Slick

[57] ABSTRACT

A mechanism is provided for filling a valved paper bag. Such bags are well-known in the art and include a valve which, upon filling of the bag, closes automatically to seal the contents of the bag. Following filling of the bag, it is removed and replaced with an empty bag. Heretofore this removal has been accomplished by an operator removing by hand the bag from a filling nozzle to a place for removal. Thus the operator must lift many hundreds of pounds in the course of a working day. In accordance with this invention, a bag is positioned, filled and then is ejected automatically without any lifting of a filled bag by the operator.

7 Claims, 15 Drawing Figures

PACKER-FILLER MACHINE

SUMMARY OF THE INVENTION

A packer-filler is provided wherein a valved bag is engaged by the filler and automatically discharged onto a conveyor when filled to a desired weight.

DESCRIPTION OF THE DRAWINGS

In the drawings accompanying and forming a part hereof.

DESCRIPTION OF THE PREFERRED EMBODIMENT

Figure 1:
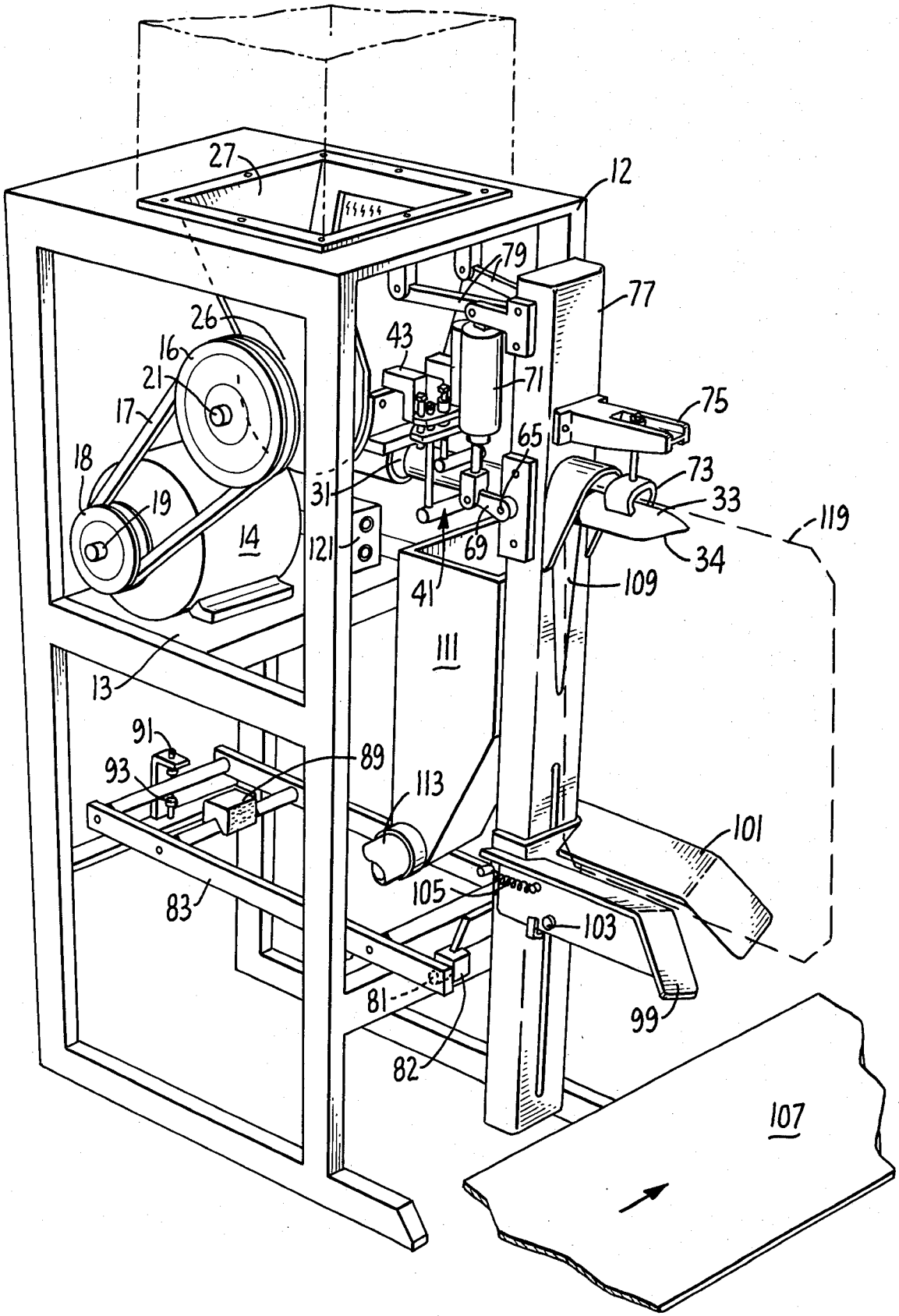
FIG. 1 is a perspective view showing the completed structure.

Referring to the drawings in which there is shown the best mode of practicing the invention, the entire mechanism is mounted upon a suitable structural steel framework generally indicated at 12 and having a platform 13 at an intermediate elevation on the frame and upon which is mounted a prime mover such as electric motor 14 driving a pulley 16 by means of a belt 17 trained about pulley 18 on motor shaft 19. Pulley 16 is mounted upon a shaft 21 which, as appears in FIG. 2, carries an impeller 23 having a plurality of impeller blades 24. The impeller is mounted in a casing 26 positioned beneath a hopper 27 into which the material to be bagged is placed.

About its lower portion hopper 26 includes an opening 28 closed by an arcuate cover 29 which is spaced from the path of travel of the tips of the impeller blades 24. Any metal or like foreign material entering the hopper drops into the space thus provided for later removal. The movable cover 29 also permits access to the impeller 24 for examination or repair.

The impeller 24 forces material out through an outlet 31 which, in turn, is connected to a flexible tube 32.

Tube 32 is connected to a rigid feed tube 33 which terminates in nozzle 34.

Figure 2:
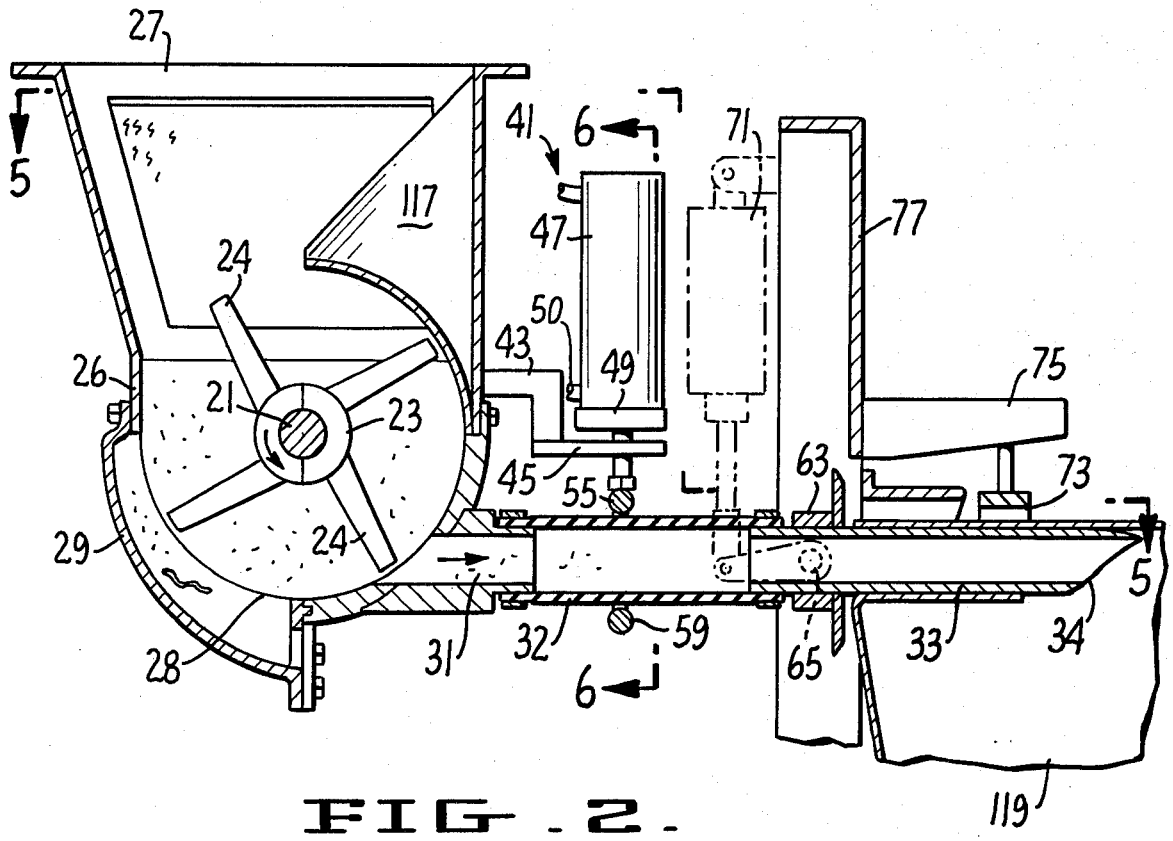
FIG. 2 is a cross section taken through the filling mechanism.
Figure 3:
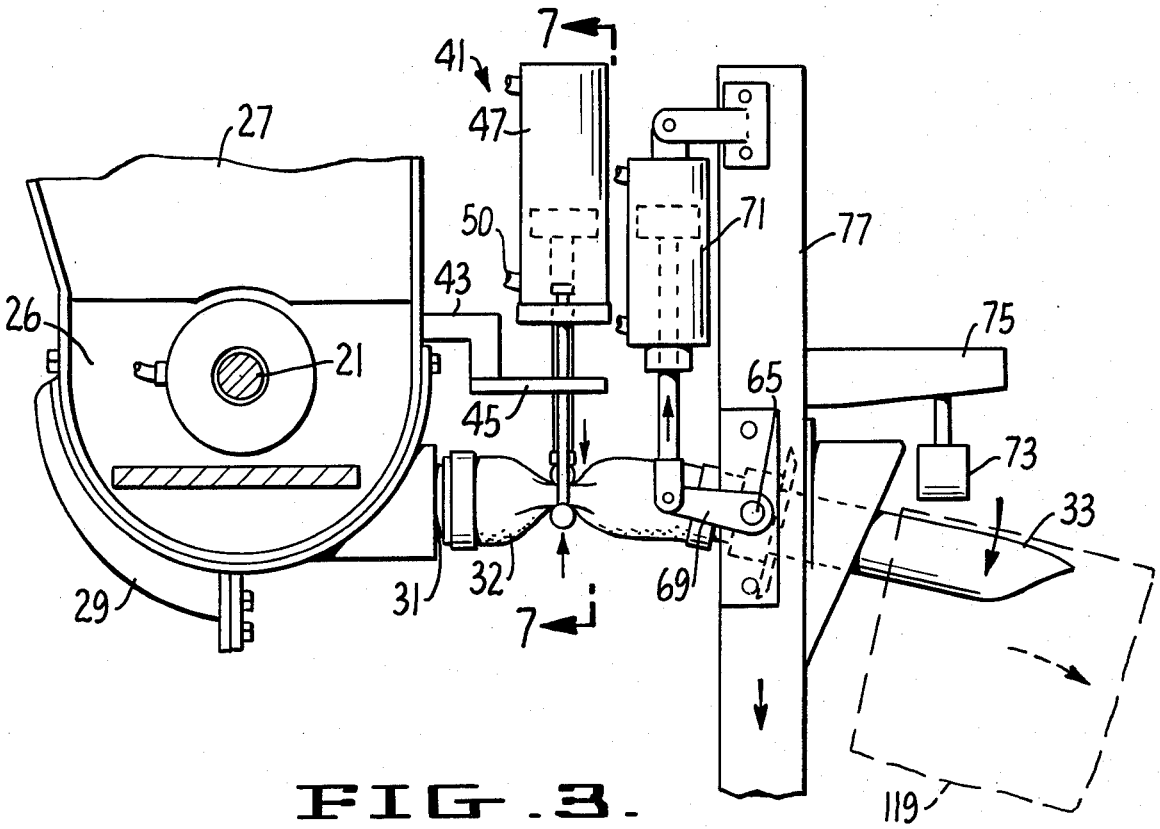
FIG. 3 is a section similar to FIG. 3 showing the position of the parts at the conclusion of a filling operation.
Figure 4:
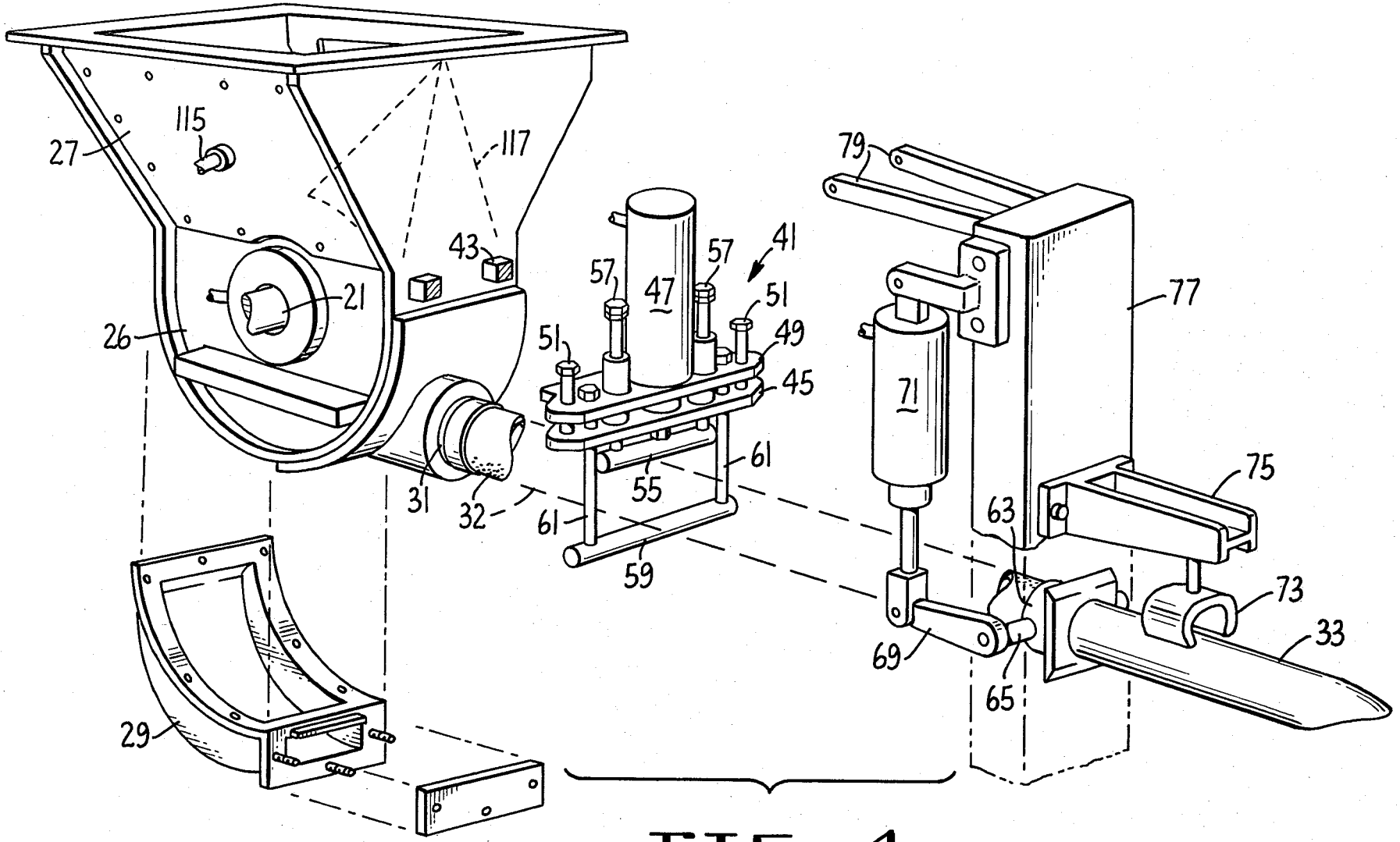
FIG. 4 is an exploded perspective view of the entire filling mechanism.
Figure 5:
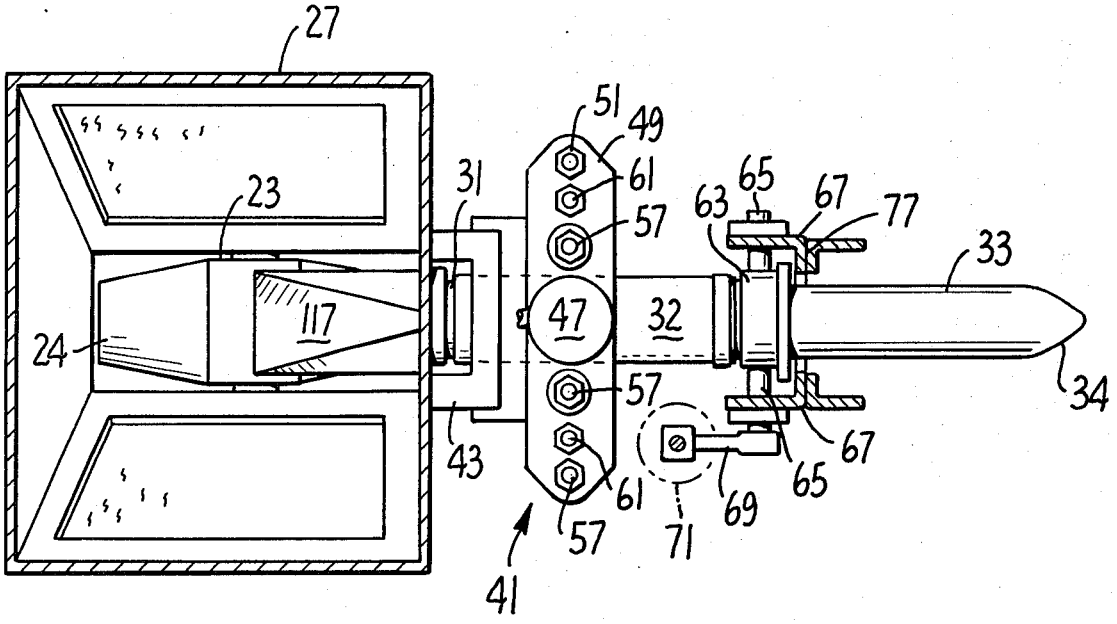
FIG. 5 is a plan view of the filling mechanism.
Figure 6:
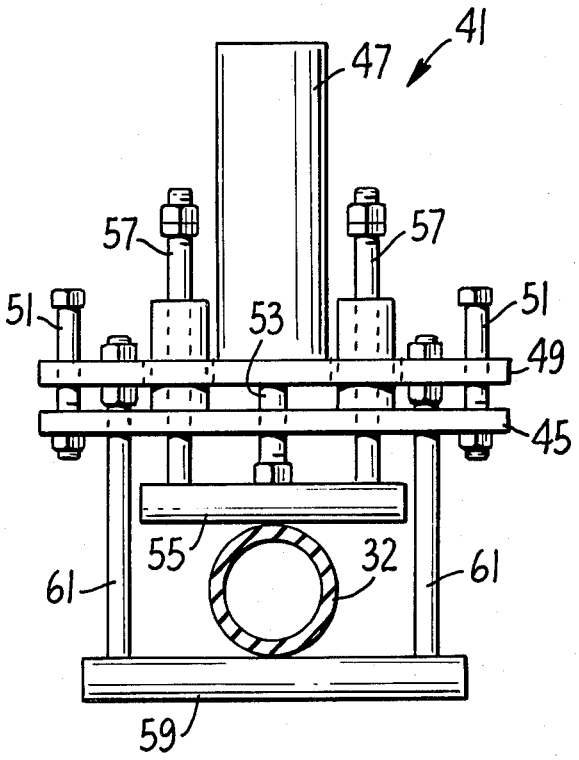
FIG. 6 is a section taken on the line 6—6 of FIG. 2.
Figure 7:
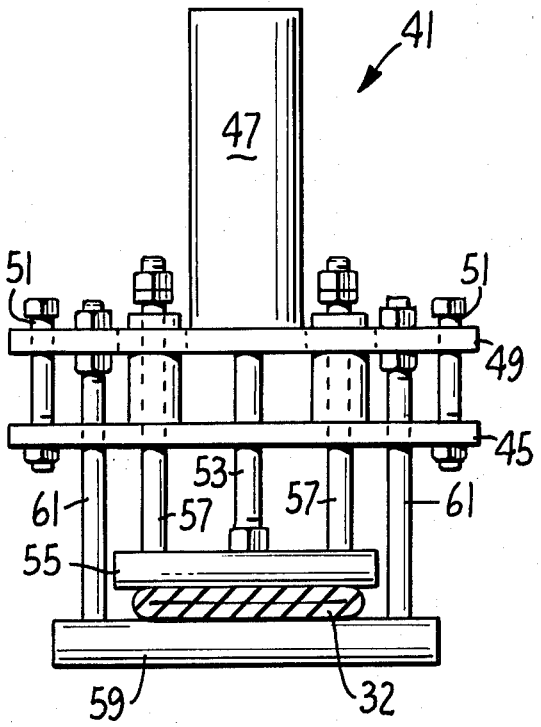
FIG. 7 is a section taken on line 7—7 of FIG. 3.

Passage of material through the flexible tube 32 is controlled by the mechanism generally indicated at 41 and shown in an open position in FIG. 2 and in a closed position in FIG. 3. The mechanism is mounted on a fixed bracket 43 which supports the fixed frame member 45. A pneumatic cylinder 47 is mounted on a movable plate 49 which is adapted to slide up and down on the guides 51. Cylinder 47 has a piston rod 53 which is attached to the upper pressure bar 55 and is adapted to glide up and down on fixed plate 45 by means of the guides 57. Lower pressure bar 59 is attached to the movable plate 49 by means of rods 61. The action can be best be seen by comparing FIGS. 6 and 7. When fluid under pressure is applied through inlet 50, the rod 53 on the piston is pushed downwardly which causes the pressure bar 55 to move downwardly. At the same time cylinder 47 is moved upwardly carrying with it lower pressure bar 59. The net result is that tube 32 is compressed both from the top and bottom as can be seen in FIG. 7, thus cutting off the flow of material until the pressure is released from the cylinder 47.

The normal position of the rigid filling tube 33 is horizontal, as is best seen in FIG. 2. The rigid tube is provided with a collar 63 which is mounted on a shaft 65 which is pivoted on frame members 67. The shaft 65 is connected to a crank arm 69 which can be actuated by pneumatic cylinder 71. When the cylinder 71 is actuated, pulling up on arm 69, see FIG. 3, nozzle 33 tilts downwardly.

A C-shaped clamp 73 is mounted on arm 75 attached to the floating frame 77. The positioning of clamp 73 is such that when the nozzle 33 is in the horizontal position, a valve bag placed over the nozzle will be gripped between the clamp 73 and nozzle 33 and will be released as the nozzle tilts.

At the front of the machine a movable bag support is mounted. This consists primarily of the floating frame 77 which is mounted for restricted up and down movement at the top by means of the arms 79 which are pivoted to the frame 12 and the bottom is mounted on blocks 82 which rests on the knife edge 81 on the movable platform 83. Platform 83 is pivoted on a second knife edge 85 mounted on bar 87 attached to frame 12. The platform 83 has a movable weight 89 and the up and down movement of the platform is limited by the screws 91 and 93. A miniature switch 95 is mounted on frame 12 with its contact arm 97 just above the frame member 83. The purpose of this switch will be later explained.

Figure 9:
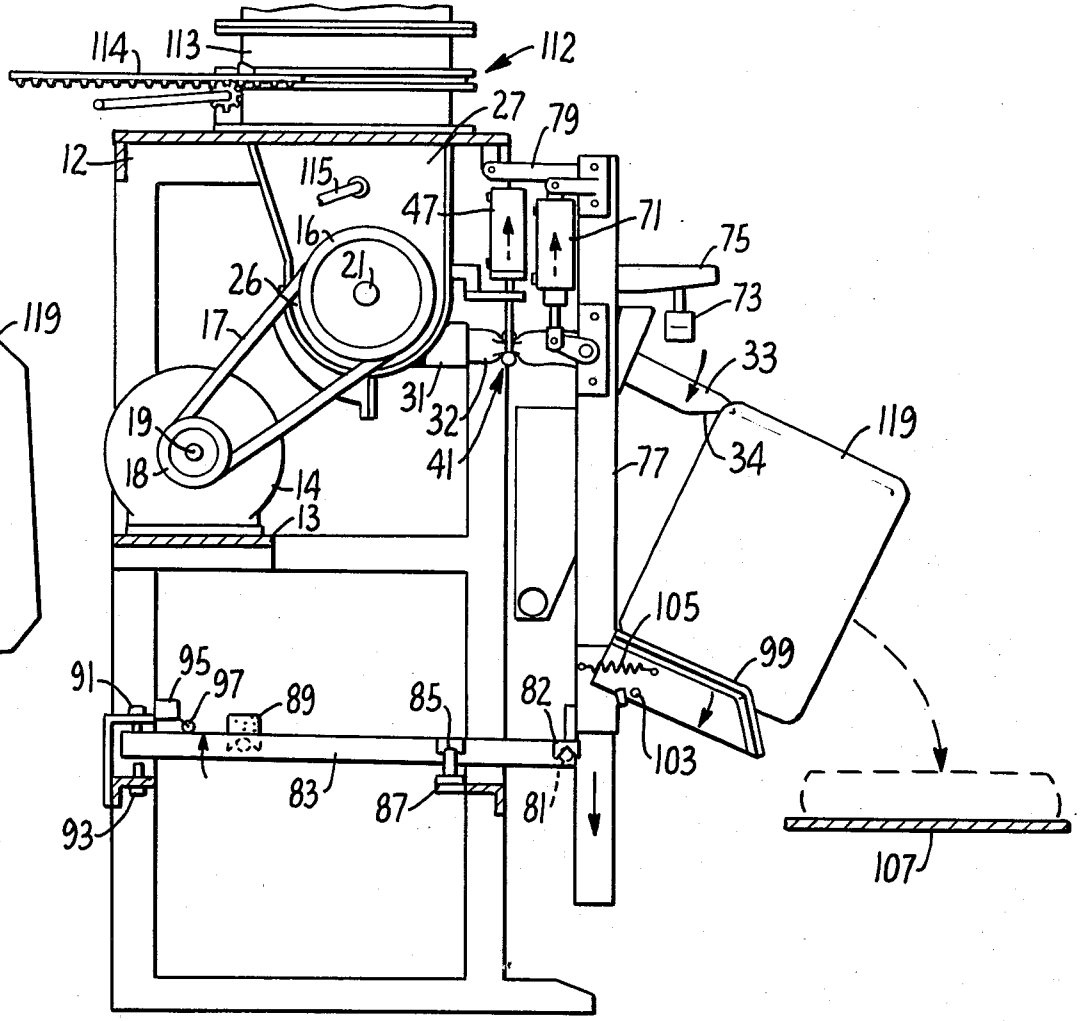
FIG. 9 is a side elevation similar to FIG. 8 showing the ejection of a filled bag from the mechanism.
Figure 8:
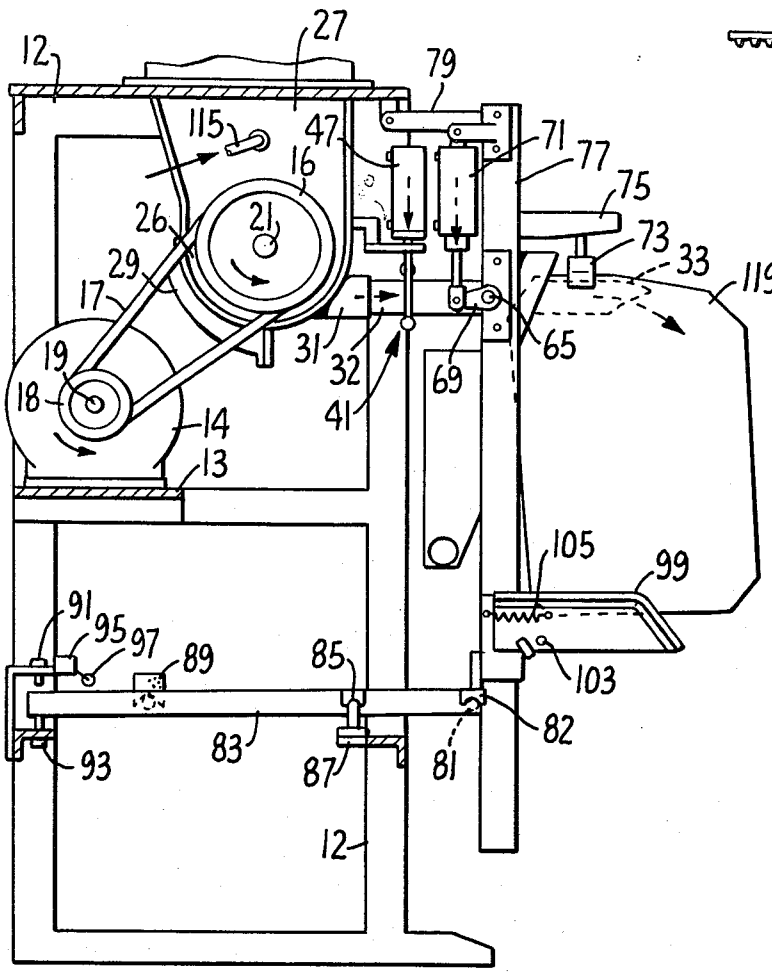
FIG. 8 is a side elevation showing the start of a bag-filling operation.
Figure 10:
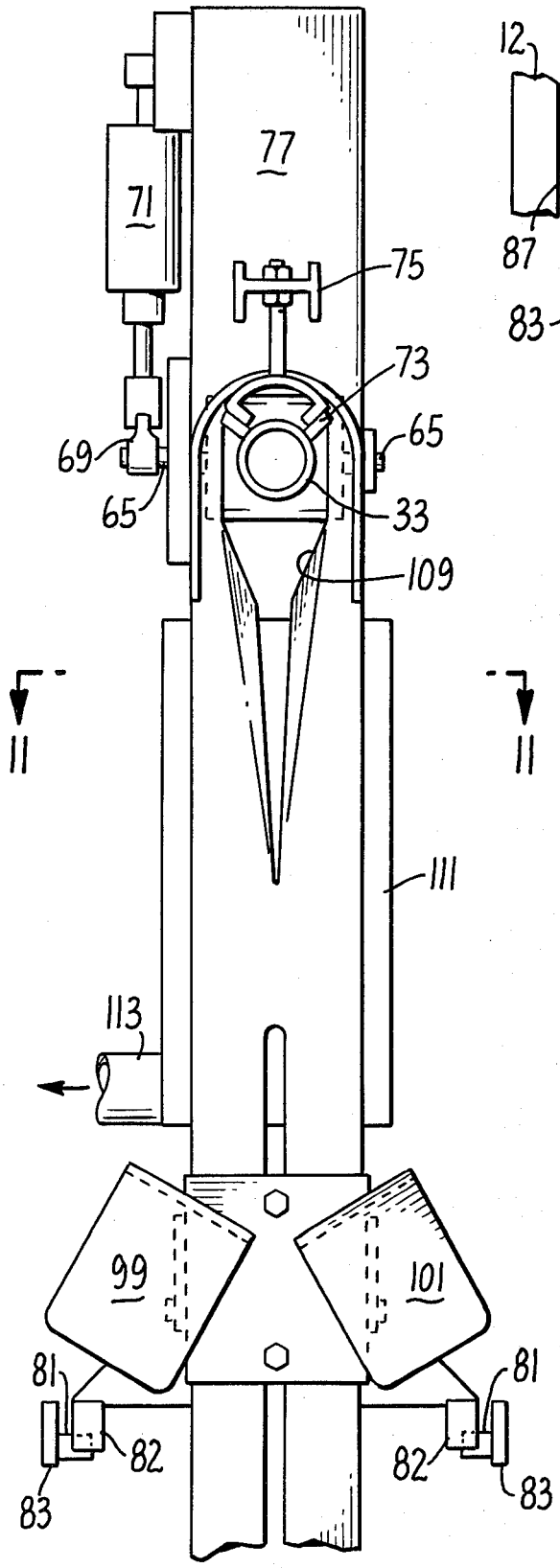
FIG. 10 is a partial front view of the structure, particularly showing an exhaust mechanism for removing any dust or other material which might escape the filling operation.
Figure 11:
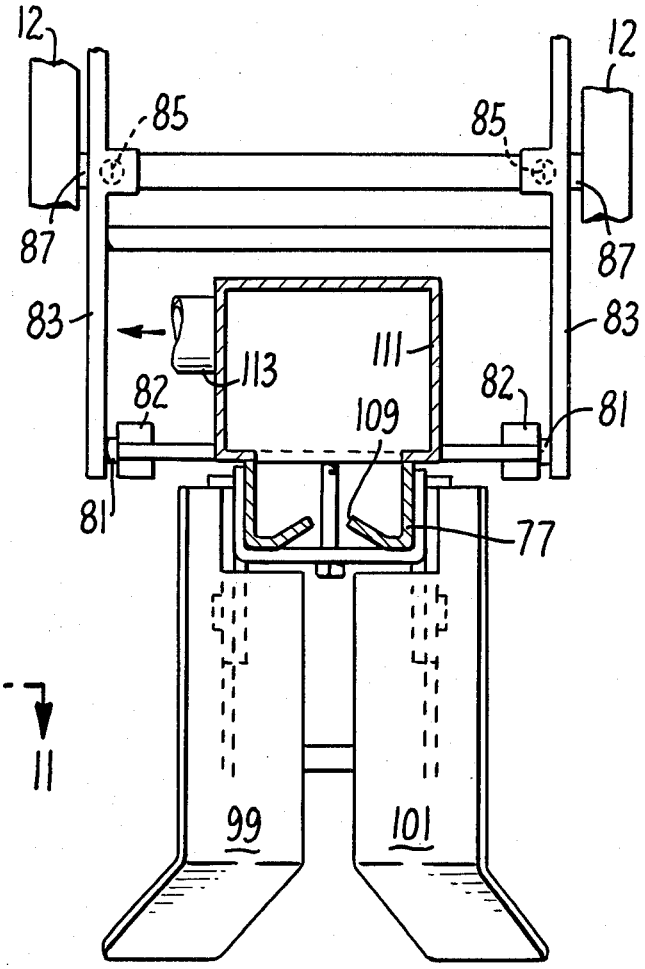
FIG. 11 is a section taken on the line 11—11 of FIG. 10.
Figure 12:
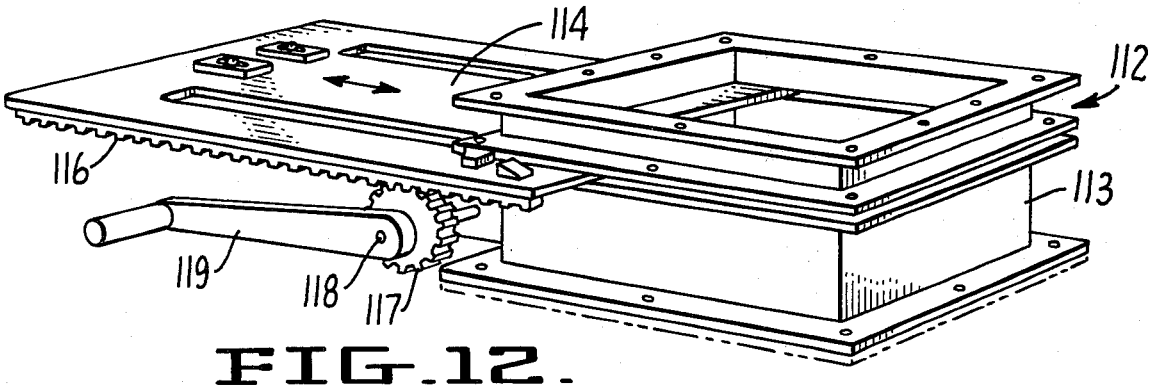
FIG. 12 is a perspective view of the valve used to control the feed of material from the main storage bin (not shown) through conduit 112 (FIG. 5).
Figure 13:
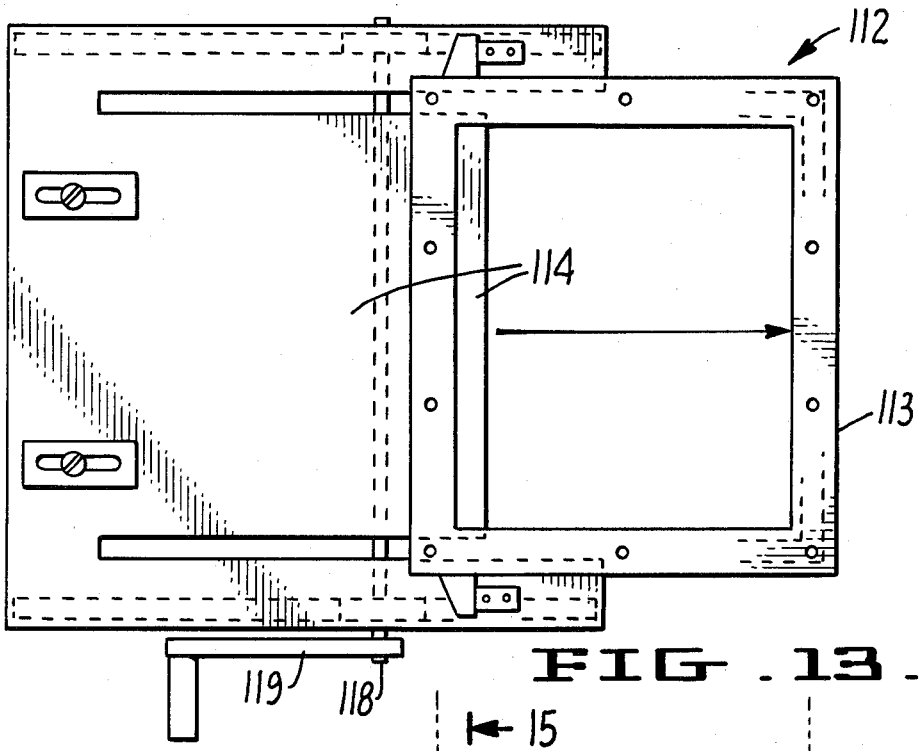
FIG. 13 is a plan viewof the valve shown in FIG. 12.
Figure 14:
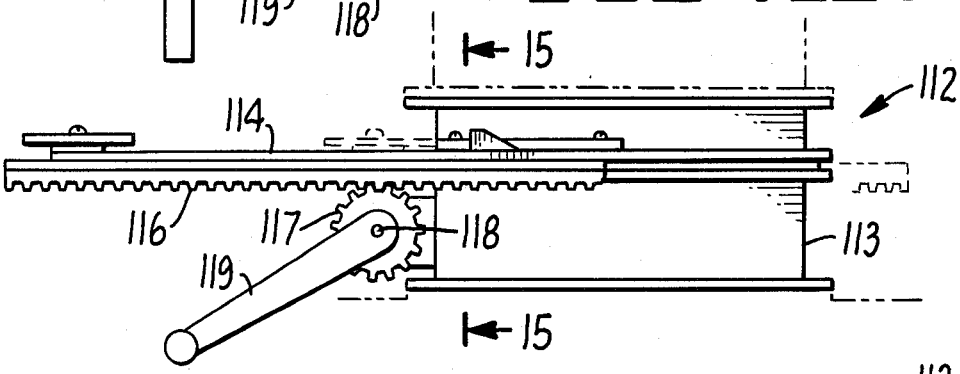
FIG. 14 is a side elevation showing the means for moving the valve slide member 114 with a rack and pinion.
Figure 15:
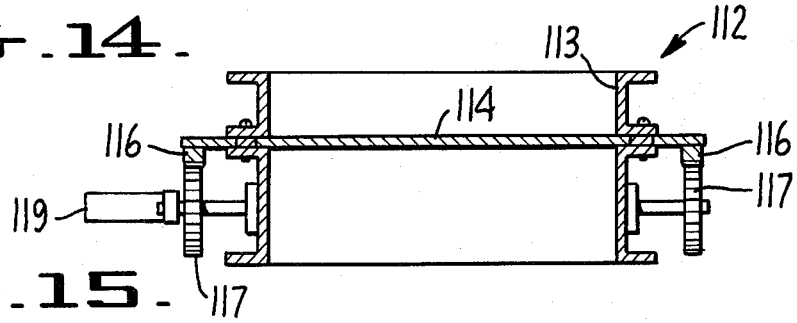
FIG. 15 is a section taken along the line 15—15 in FIG. 14.

The movable member 77 carries a pair of bag supporting arms 99 and 101 which are pivoted by means of pin 103 to the member 77 and normally held in a horizontal position by means of a spring 105. As can best be seen in FIGS. 8 and 9, the pivot point 103 is close to the support member 77 so that a load placed on the arms 99 and 101 normally would cause the arms to tilt unless the load placed thereon is supported in some other manner. The arms 99 and 101 are placed adjacent to a discharge position which normally would be a conveyor belt such as that shown at 107.

Since many of the materials handled by the filler are of a dusty nature, it is desirable to provide a dust collector and this can take the form of a slot 109 in front of the member 77 leading to a chamber 111 which is connected to a suction line 113. The top of the chamber 111 is open so that any dust which falls out of the bag or which falls behind the arm 77 is swept away.

The hopper 27 may be provided with an air inlet 115 so that the material within the hopper is kept in a state of agitation. Also, the hopper is provided with an internal deflector 117 which tends to keep the material from bridging within the hopper and insures an even flow into the bag.

The valve 112 includes a body 113 having a valve member 114 mounted in the body to control flow of material from a storage bin (not shown). The valve member 114 is moved across body 113 by means of a rack 116 which is engaged with pinion 117 mounted on a shaft 118 which, in turn, is moved by the crank 119. When it is necessary to work upon some portion of the mechanism and flow of material must be discontinued, the slide valve 114 can be moved across the body 113 to cut off the flow of material from the main storage bin.

The operation of the machine can now be described. At the start of an operation, the parts would be in the position shown in FIG. 9 with the nozzle 33 tilted downwardly and with the tube 32 clamped shut. Motor 41 would be off. One now places an empty bag 119 over the nozzle 33 and depresses the start switch 121. This starts the motor 14 and also causes the nozzle 33 to tilt upwardly so that the bag is grasped between the clamp 73 and the nozzle 33 and at the same time causes cylinder 47 to retract opening the tube 32. The spring 105 is strong enough to hold the arms 99 and 101 in a horizontal position. Now as the bag is filled it finally reaches a desired weight, as determined by the counterweight 89 on frame 83, and the member 77 will move downwardly, so that the frame 83 will contact the switch arm 97. This causes the motor 14 to stop, causes cylinder 47 to close tube 32 and causes cylinder 71 to tilt the nozzle 33 downwardly, as can best be seen in FIG. 9, so that the bag is no longer clamped between nozzle 33 and clamp 73. As was previously mentioned, the arms 99 and 101 are pivoted near the member 77 so that when the upper portion of the bag is no longer clamped, weight of the bag causes the arms to tilt from the horizontal position, as can best be seen in FIG. 9, causing the filled sack 119 to fall onto the conveyor 107. It is not necessary for a workman to lift the bag off the machine as it is changed automatically and falls onto the conveyor as soon as it is brought to the proper weight. At this point, the nozzle 33 is tilted downwardly so that the parts are in a position for a repetition of the cycle as outlined above.

The circuit diagram connecting the switches and pneumatic cylinders is well-known to those skilled in the art and therefore has not been described.

Many variations can be made on the exact structure shown without departing from the spirit of this invention. For instance, a flexible tube with a pinch means is employed as the valve in a preferred embodiment of the invention. However, other well known valve means, such a a slide valve, can be substituted for the pinch valve illustrated.

I claim:

1. A packer-filler machine comprising in combination:

(a) impeller means for forcing material from a source, (b) a nozzle for discharging said material into a bag to be filled, (c) the said nozzle being movable from a first horizontal position to a second tilted position wherein the terminal end of said nozzle is tilted downwardly, (d) fixed clamp means mounted above the terminal end of said nozzle and spaced therefrom so that a bag is engaged between the terminal end of said nozzle and said fixed clamp when said nozzle is in a horizontal position and said bag is released when said nozzle is in a tilted position, (e) means for holding said nozzle in a horizontal position while a bag is being filled, and (f) means for releasing said bag from engagement between the terminal end of said nozzle and said fixed clamp by tilting said nozzle downwardly when said bag is filled.

2. A packer-filler machine as in claim 1 having valve means between said impeller means and said nozzle and means for opening said valve means when said nozzle is in a horizontal position and closing said valve means when said nozzle is tilted downward.

3. A packer-filler machine as in claim 2 wherein a flexible member is provided to feed material to the nozzle, and means are provided for opening and closing the flexible member as the nozzle is moved from its first position to a tilted position, constituting said valve means.

4. The packer-filler of claim 1 wherein said impeller means revolves in a close-fitting arcuate housing and having a second arcuate housing outside the path of travel of said impeller means whereby heavy material will be displaced into said second arcuate housing and removed from the stream of material fed into said nozzle.

5. In a bag filling machine in accordance with claim 3 having a flexible tube providing passage for material from a source of supply to a bag, a cylinder and piston structure, a frame extending from the cylinder and piston structure and having opposite members positioned on opposite sides of the flexible tube, the elements being movable upon fluid application to the cylinder to move the member to compress the tube and so stop the flow of material through the tube.

6. Means for opening and closing a flexible tube in accordance with claim 5 through which material is fed, such means comprising a cylinder mounted upon a support, a piston in the cylinder, means for admitting a fluid to the cylinder to move the cylinder and the piston in opposite directions, the piston having attached thereto a crossbar resting upon one surface of the flexible tube, the cylinder having a frame secured thereto and carrying a crossbar substantially parallel to the first mentioned crossbar, the two bars being movable toward and away from one another upon admission of a fluid under pressure to the cylinder effective to move the support for the second crossbar and to move the piston to move the first crossbar to compress the flexible tube.

7. The packer-filler of claim 1 having the following additional structure:

(a) a hopper means located above said impeller means, (b) a slide valve between said hopper means and said impeller means whereby, (c) flow of material from said hopper means to said impeller means can be emitted.

* * * * *